US005665455A

United States Patent [19]

Sato et al.

[11] Patent Number: 5,665,455

[45] Date of Patent: Sep. 9, 1997

[54] LOW-IRON-LOSS GRAIN-ORIENTED ELECTROMAGNETIC STEEL SHEET AND METHOD OF PRODUCING THE SAME

[75] Inventors: Seiji Sato; Masayoshi Ishida; Kunihiro Senda; Kazuhiro Suzuki; Michiro Komatubara, all of Okayama, Japan

[73] Assignee: Kawasaki Steel Corporation, Japan

[21] Appl. No.: 638,314

[22] Filed: Apr. 26, 1996

Related U.S. Application Data

[63] Continuation of Ser. No. 363,697, Dec. 23, 1994, abandoned.

[30] Foreign Application Priority Data

| | | | |
|---|---|---|---|
| Dec. 28, 1993 | [JP] | Japan | 5-335649 |
| Mar. 23, 1994 | [JP] | Japan | 6-051608 |
| Mar. 31, 1994 | [JP] | Japan | 6-063179 |

[51] Int. Cl.[6] ..... B32B 3/28

[52] U.S. Cl. ..... 428/167; 428/141; 428/212; 428/593; 428/600; 156/209; 156/257

[58] Field of Search ..... 428/156, 167, 428/120, 141, 212, 209, 457, 900, 901, 596, 600; 72/324; 156/209, 244.25, 250, 257, 664; 409/304; 29/895

[56] References Cited

U.S. PATENT DOCUMENTS

| | | | |
|---|---|---|---|
| 4,063,838 | 12/1977 | Michael | 403/343 |
| 4,996,113 | 2/1991 | Hector et al. | 428/600 |

FOREIGN PATENT DOCUMENTS

| | | |
|---|---|---|
| 0 108 575 | 5/1984 | European Pat. Off. . |
| 0 287 357 | 10/1988 | European Pat. Off. . |
| 0 539 236 | 4/1993 | European Pat. Off. . |
| 28 19 514 | 11/1978 | Germany . |

OTHER PUBLICATIONS

IEEE Transactions on Magnetics, vol. 23, No. 511, Sep. 1987, New York, U.S., pp. 3074–3076, M. Nakamura et al *Domain Refinement of Grain Oriented Silicon Steel by Laser Irradiation.*

*Primary Examiner*—Donald Loney
*Attorney, Agent, or Firm*—Austin R. Miller

[57] ABSTRACT

A low-iron-loss grain-oriented electromagnetic steel sheet is provided with the multiplicity of linear grooves formed in a surface thereof to extend in a direction substantially perpendicular to the direction of rolling of the steel sheet at a predetermined pitch in the direction of rolling, and a multiplicity of linear high dislocation density regions introduced to extend in a direction substantially perpendicular to the direction of rolling of the steel sheet at a predetermined pitch in the direction of rolling. The pitches $l_1$ and $l_2$ of the linear grooves and the high dislocation density regions, respectively, satisfy equations (1) and (2):

$$1 \leqq l_1 \leqq 30 \text{ (mm)} \quad (1)$$

$$5 \leqq \sqrt{l_1} \times l_2 \leqq 100. \quad (2)$$

10 Claims, 10 Drawing Sheets

LOW-IRON-LOSS GRAIN-ORIENTED ELECTROMAGNETIC STEEL SHEET AND METHOD OF PRODUCING THE SAME

This application is a continuation of application Ser. No. 08/363,697, filed Dec. 23, 1994 now abandoned.

BACKGROUND OF THE INVENTION

1. Field of the Invention

The present invention relates to a low-iron-loss grain-oriented electromagnetic steel sheet and also to a method of producing such a steel sheet.

2. Description of Related Arts

Grain-oriented electromagnetic steel sheets are used mainly in transformer cores and, hence, are required to have superior magnetic characteristics. In particular, it is important that the steel sheet minimize energy loss, also known as iron loss, when used as the core material.

In order to cope with such a demand, various techniques have been proposed such as enhancing the degree of alignment of crystal texture in (110)[001] orientation, increasing electric resistivity of steel sheet by enriching the Si content, reducing the impurity content, reducing the sheet thickness, and so forth. Presently, steel sheets of 0.23 mm or thinner, having iron loss $W_{17/50}$ (iron loss exhibited when alternatingly magnetized at 50 Hz under maximum magnetic flux density of 1.7 T) of 0.9 W/kg or less are successfully produced. However, the limits of iron loss reduction attainable through metallurgical techniques have likely been reached.

In recent years, therefore, various attempts and proposals have been made to artificially realize fine magnetic domains in steel sheets as a measure for achieving a remarkable reduction in the iron loss. One such attempt or proposal, actually carried out in industrial scale, involves irradiating the surface of a finish-annealed steel sheet with a laser beam. The steel sheet produced by this method possesses regions of high dislocation density, formed as a result of the high energy imparted by the laser beam. These regions of high dislocation density cause 180° magnetic domains to be finely defined, thus contributing to reduction in iron loss.

It should be noted, however, that steel sheets thus produced cannot be used as wound transformer cores because the high temperatures associated with the required strain-relieving annealing increase iron loss by destroying the high dislocation density regions.

Methods have been proposed for enabling such strain-relieving annealing. For instance, Japanese Patent Publication No. 62-54873 discloses a method in which insulating coating on a finish-annealed steel sheet is locally removed by, for example, laser beam or mechanical means, followed by pickling of the local portions where the insulating coating has been removed. Japanese Patent Publication No. 62-54873 also discloses a method in which linear grooves are formed in the matrix iron by scribing with mechanical means such as a knife, and the grooves are filled by a treatment for forming a phosphate type tension imparting agent. Meanwhile, Japanese Patent Publication No. 62-53579 discloses a method in which grooves of 5 μm or deeper are formed in finish-annealed steel sheet by application of a load of 90 to 220 kg/mm$^2$, followed by heat treatment conducted at 750° C. or above.

Japanese Patent Publication No. 3-69968 discloses a method in which a steel sheet which has undergone finish cold rolling is linearly and finely fluted in a direction substantially perpendicular to the direction of rolling.

In the known art described above, linear grooves or flutes are formed in the surface of the steel sheet, and the magnetic poles appearing near the grooves or flutes finely define magnetic domains. It is considered that such fine definition of magnetic domains is one of the reasons why the iron loss is reduced.

Thus, low-iron-loss steel sheets which can be subjected to strain-relieving annealing have become available by virtue of the methods described above. It has been found, however, that such steel sheets are sometimes significantly inferior to the steel sheets of the type disclosed in Japanese Patent Publication No. 57-2252 which have linear high dislocation density regions.

SUMMARY OF THE INVENTION

Accordingly, an object of the present invention is to provide a grain-oriented electromagnetic steel sheet in which reduction in iron loss is attained through formation of linear grooves or flutes.

To this end, according to one embodiment of the present invention, there is provided a grain-oriented electromagnetic steel sheet comprising a body of finish-annealed grain-oriented steel sheet, the steel sheet being provided with a multiplicity of linear grooves formed in a surface thereof so as to extend in a direction crossing the direction of rolling of the steel sheet, at a predetermined pitch in the direction of the rolling, and a multiplicity of linear high dislocation density regions introduced so as to extend in a direction crossing the direction of rolling of the steel sheet, at a predetermined pitch in the direction of the rolling, at positions different from the positions where the linear grooves are formed.

Preferably, the angles formed by the linear grooves and the high dislocation density regions are not greater than 30° with respect to the direction perpendicular to the direction of the rolling. It is also preferred that each of the linear grooves has a width of from about 0.03 mm to about 0.30 mm and a depth of from about 0.01 mm to about 0.07 mm, while each of the high dislocation density regions has a width of from about 0.03 mm to about 1 mm.

The pitch of the linear grooves, as well as the pitch of the high dislocation density regions, ranges from about 1 mm to about 30 mm.

Another embodiment of the invention provides a low-iron-loss grain-oriented electromagnetic steel sheet, comprising a body of finish-annealed grain-oriented electromagnetic steel sheet, the steel sheet being provided with a multiplicity of linear grooves formed in a surface thereof so as to extend in a direction substantially perpendicular to the direction of rolling of the steel sheet, at a predetermined pitch $l_1$ in the direction of the rolling, and a multiplicity of linear high dislocation density regions introduced so as to extend in a direction substantially perpendicular to the direction of rolling of the steel sheet, at a predetermined pitch $l_2$ in the direction of the rolling, wherein the pitches $l_1$ and $l_2$ of the linear grooves and the high dislocation density regions, respectively, are determined to meet the conditions of the following equations (1) and (2):

$$1 \leqq l_1 \leqq 30 \text{ (mm)} \quad (1)$$

$$5 \leqq \sqrt{l_1} \times l_2 \leqq 100 \quad (2)$$

Another embodiment of the invention provides a method of producing a low-iron-loss grain-oriented electromagnetic steel sheet, comprising preparing a finish-annealed grain-oriented electromagnetic steel sheet having linear grooves formed in a surface thereof so as to extend in a direction crossing the direction of rolling of the steel sheet, at a pitch $l_1$ (mm) in the direction of the rolling; and introducing minute linear regions of rolling strain extending in a direction crossing the direction of the rolling, at a pitch $l_3$ (mm) which is determined in relation to the pitch $l_1$ of the linear grooves, so as to meet the conditions of the following equations (1) and (3):

$$1 \leqq l_1 \leqq 30 \text{ (mm)} \quad (1)$$

$$5 \leqq \sqrt{l_1} \times l_3 \leqq 100 \quad (3)$$

Preferably, each of the linear grooves has a width of from about 0.03 mm to about 0.30 mm and a depth of from about 0.01 mm to about 0.07 mm and extends in a direction which forms an angle not greater than about 30° to a direction which is perpendicular to the direction of the rolling.

It is also preferred that the introduction of the minute linear regions of rolling strain is conducted by pressing a roll having linear axial protrusions against the steel sheet at a surface pressure of about 10 to about 70 kg/mm$^2$, the linear axial protrusions of the roll having a width of from about 0.05 mm to about 0.50 mm and a height of from about 0.01 mm to about 0.10 mm and extending in a direction which forms an angle of not greater than about 30° to the roll axis.

These and other objects, features and advantages of the present invention will become clear from the following description of the preferred embodiments when the same is read in conjunction with the accompanying drawings.

DETAILED DESCRIPTION OF THE PREFERRED EMBODIMENTS

Figure 1B:
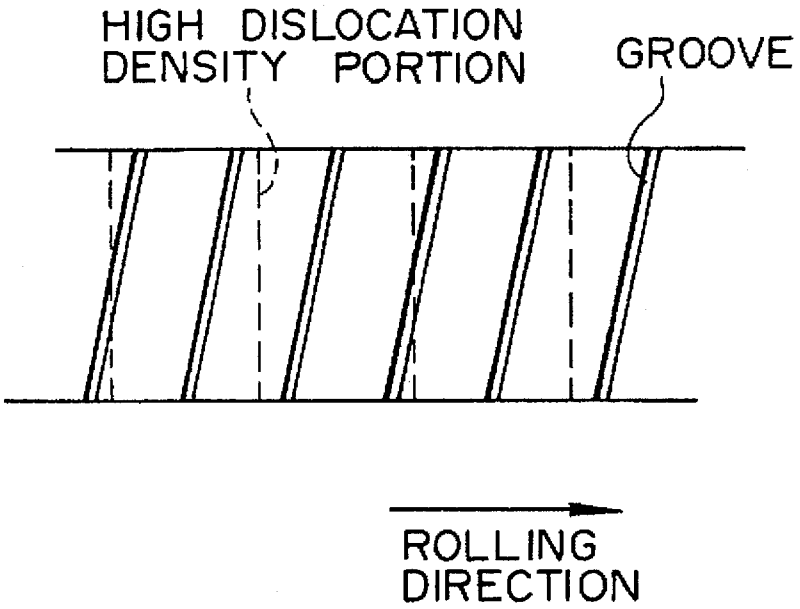
FIGS. 1A and 1B are schematic top plan views of positions of grooves and high dislocation density regions in a steel sheet.

Embodiments of the present invention will hereinafter be described in detail with reference to specific forms of the invention, but specific terms used in the specification are not intended to limit the scope of the invention which is defined in the appended claims.

A hot-rolled sheet of 3.2 wt % silicon steel, containing MnSe and AlN as inhibitors, was rolled down to 0.23 mm through two stages of cold rolling which were conducted consecutively with a single cycle of intermediate annealing executed between them. Samples of the steel sheet were then subjected to the following treatments A to E:

(A) After application of an etching resist by gravure printing, electrolytic etching was conducted to form grooves extending perpendicular to the direction of the rolling, at a groove pitch of 4 mm, groove width of 0.15 mm and a groove depth of 0.020 mm, followed by a decarburization annealing and a final finish annealing and a subsequent coating, thus forming the final product.

(B) The product prepared by the same process as (A) described above was subjected to a plasma flame irradiation which was conducted along linear paths perpendicular to the rolling direction and determined at a pitch of 4 mm so as not to overlap the grooves. Consequently, a linear region of high dislocation density of 0.30 mm wide was formed along each path of plasma flame irradiation.

(C) The product prepared by the same process as (A) described above was subjected to a plasma flame irradiation conducted along linear paths perpendicular to the rolling direction and determined at a pitch of 4 mm so as to overlap the grooves.

(D) A product was obtained through the decarburization annealing, final finish annealing and coating, without formation of grooves.

(E) Plasma flame was applied on the product (D), along paths which were perpendicular to the rolling direction and determined at a pitch of 4 mm. Consequently, a linear region of high dislocation density of 0.30 mm wide was observed along each path of plasma flame irradiation as in (B) above.

Test pieces of 150 mm wide and 280 mm long were taken out of these product sheets and subjected to measurement of magnetic characteristics according to SST (single sheet magnetic testing device) to obtain results as shown in Table 1. The term $W_{17/50}$ indicates the value of iron loss as measured with magnetic flux density of 1.7 T at a frequency of 50 Hz, while $B_8$ value indicates the magnetic flux density at magnetization power of 800 A/m.

TABLE 1

| Symbol | Treatment | $W_{17/50}$ (W/kg) | $B_8$ (T) |
|---|---|---|---|
| A | Only grooves | 0.72 | 1.90 |
| B | Grooves and high dislocation density region formed alternatingly | 0.67 | 1.90 |
| C | High dislocation density regions overlapping grooves | 0.70 | 1.90 |
| D | No grooves | 0.89 | 1.92 |
| E | Only high dislocation density region | 0.70 | 1.92 |

As will be seen from Table 1, the steel sheet product prepared by treatment (B) having linear grooves and high dislocation density regions which are formed to appear alternatingly exhibits smaller iron loss than the steel sheet product (A) which has only grooves and the steel sheet product (E) which has only high dislocation density regions. The steel sheet produced through treatment (C) also showed a reduced iron loss as compared with the steel sheet produced by the treatment (A) but the amount of reduction in iron loss was not as large as that exhibited by the steel sheet produced through the treatment (B).

It is therefore clear that grain-oriented electromagnetic steel sheet having both linear grooves and linear regions of high dislocation densities extending perpendicularly to the rolling direction without overlapping, exhibits iron loss less than that achieved by known low-iron loss grain-oriented electromagnetic steel sheets. This steel sheet offers, when used as a material comprising a laminated core which does not require strain-relieving annealing, superior performance as compared with conventional materials, and exhibits performance at least equivalent to that obtained with conventional materials even when used in a wound core which requires stress relieving.

The smaller iron loss which is observed when the high dislocation density regions do not overlap the grooves (except at intersection points of the grooves and the high density dislocation regions in some embodiments) is attributable to the greater number of magnetic poles, effective for realizing finer magnetic domains, created when the high dislocation density regions are formed between the grooves than when these regions overlap the grooves.

Figure 1A:
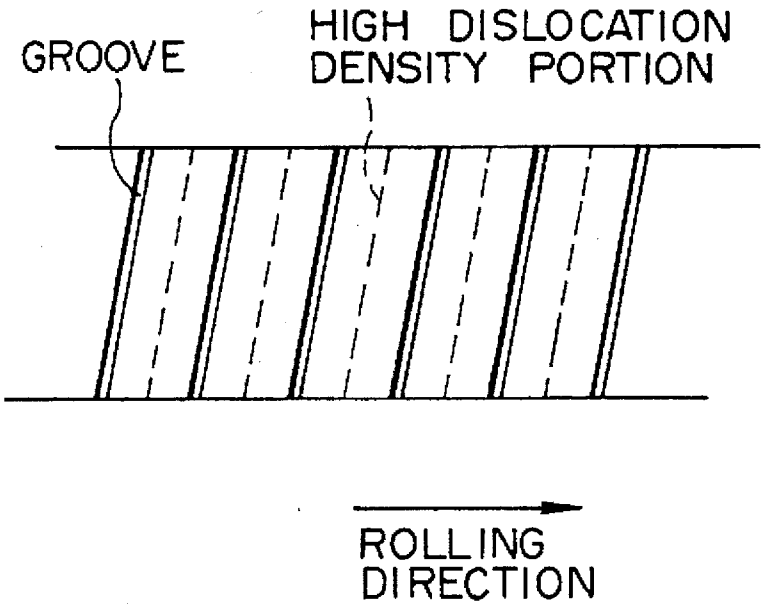

A detailed study done by the present inventors has demonstrated that a significant iron loss reduction is attained when the linear grooves and the high dislocation density regions do not overlap each other (except as noted above). It is not essential, however, that the high dislocation density regions extend parallel to the grooves at portions between adjacent grooves as illustrated in FIG. 1A. The high dislocation density regions may intersect the grooves as illustrated in FIG. 1B. Thus, a significant iron loss reduction can be attained provided that the linear grooves and the high dislocation density regions do not completely overlap each other. To maximize the iron loss reduction, however, it is preferred that the high dislocation density regions are formed between the linear grooves.

Studies performed by the inventors demonstrate that approximately the same iron loss reduction is achieved regardless of whether the linear grooves and the high dislocation density regions are formed in the same surface or opposite surfaces of the steel sheet.

Figure 2:
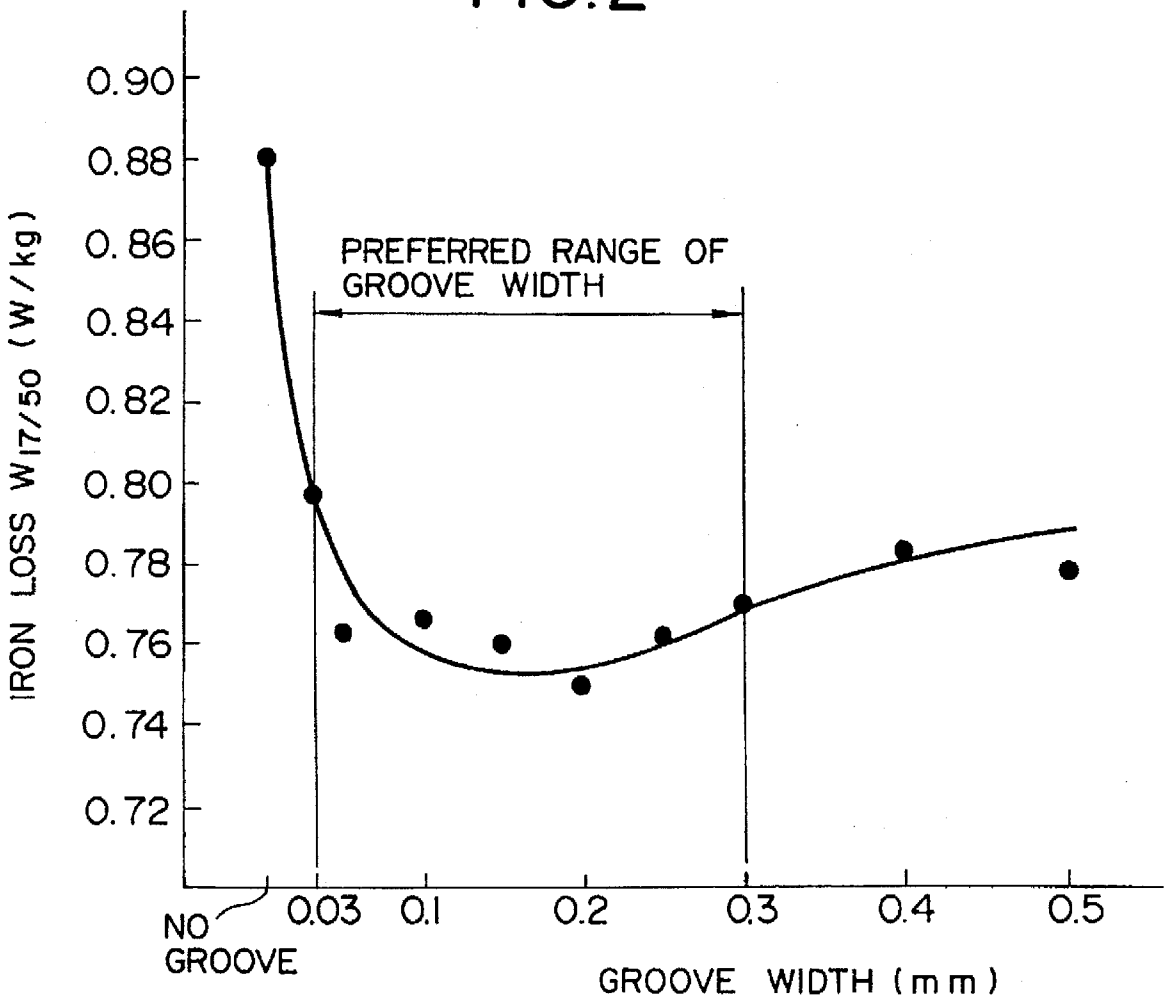
FIG. 2 is a graph of the relationship between groove width and iron loss $W_{17/50}$.
Figure 3:
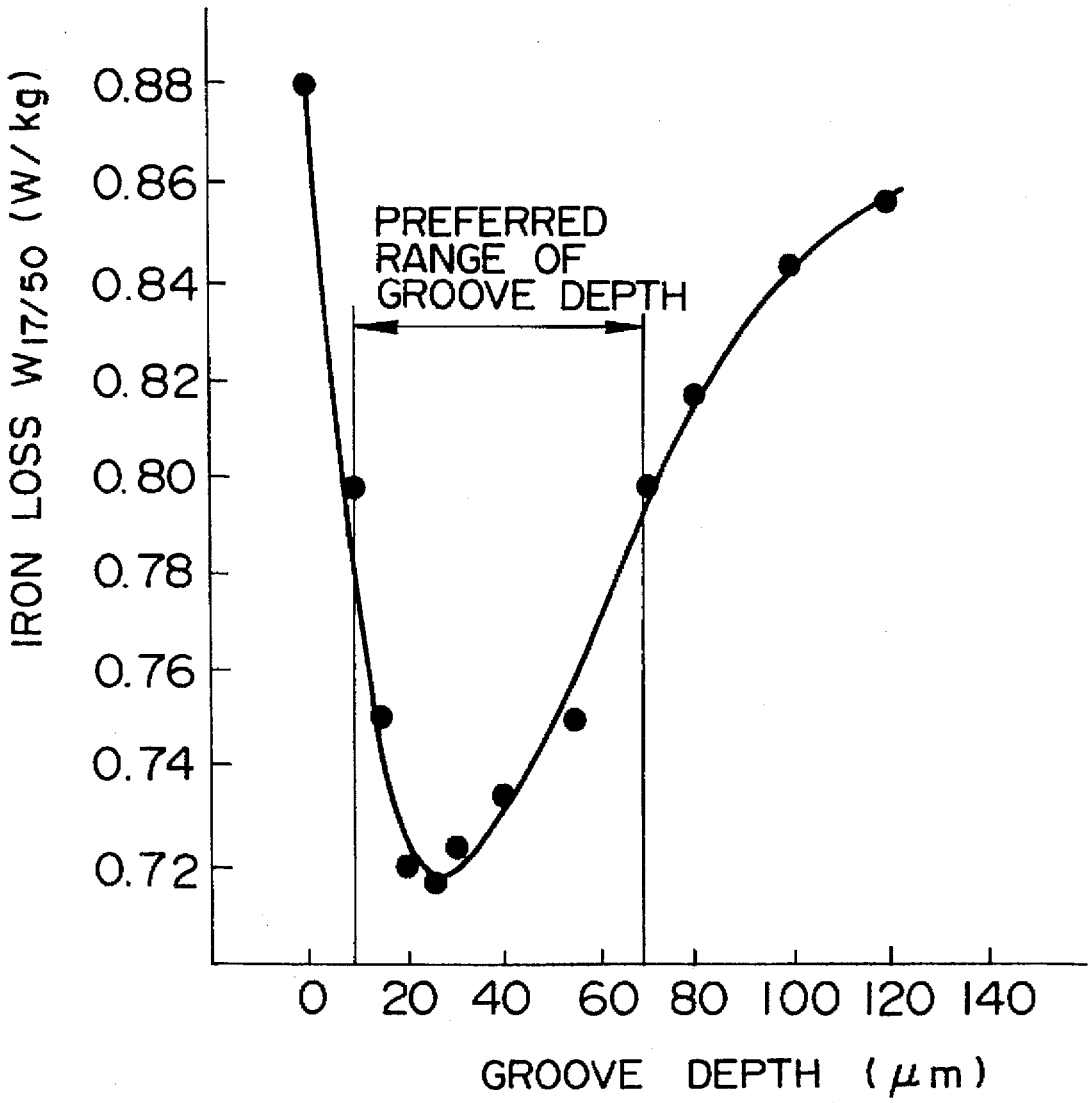
FIG. 3 is a graph of the relationship between groove depth and iron loss $W_{17/50}$.

FIGS. 2 and 3 show the relationship between groove width and iron loss $W_{17/50}$, and the relationship between groove depth and iron loss $W_{17/50}$, respectively. As these graphs reveal, stable iron losses of less than 0.80 W/kg are obtained both when the width of the linear grooves ranges from about 0.03 to about 0.30 mm and when the groove depth ranges from about 0.010 to about 0.070 mm. Significant iron loss reduction can be obtained even when the groove depth is greater than about 0.30 mm. However, in such a case, the magnetic flux density is greatly reduced. The groove width is therefore best maintained within the range of about 0.030 to about 0.30 mm.

Figure 4:
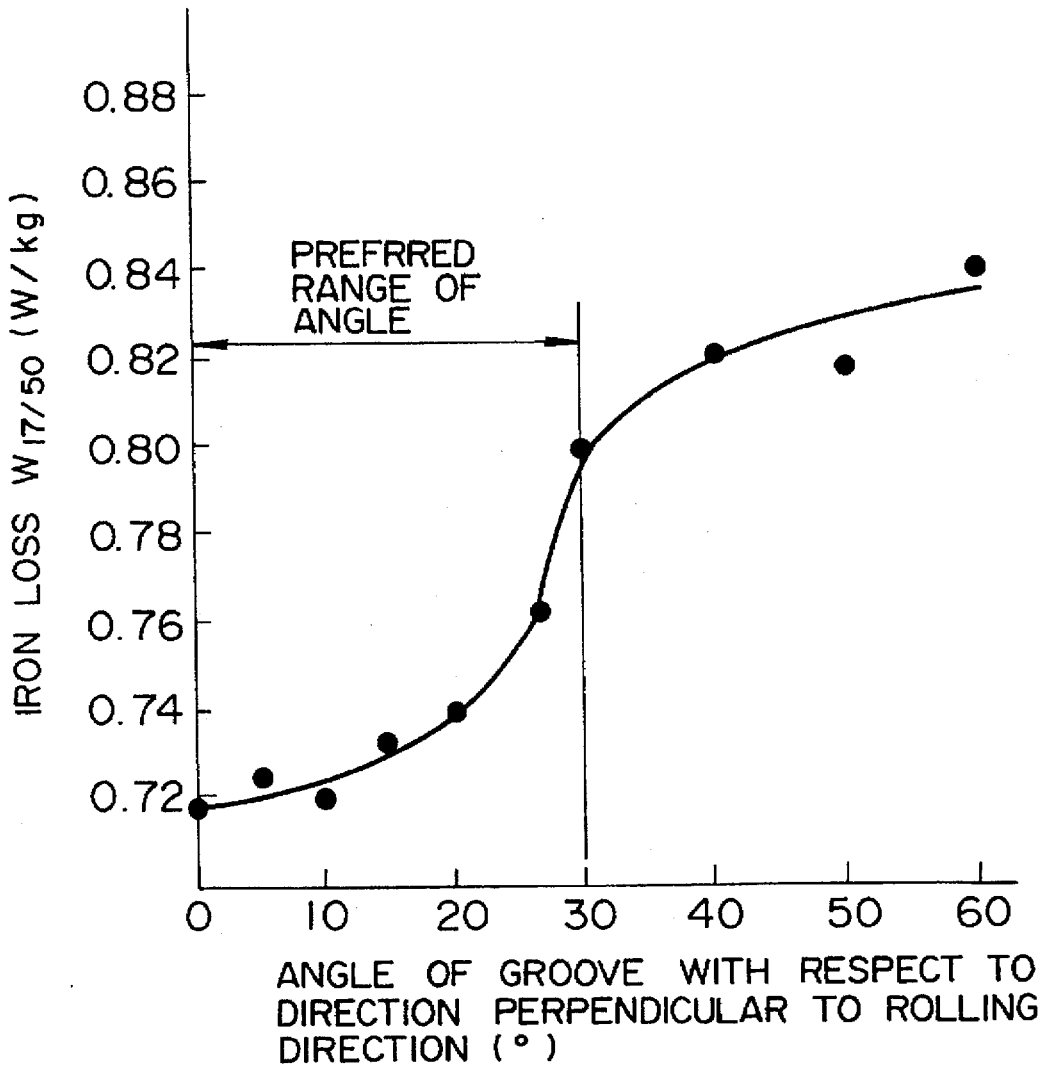
FIG. 4 is a graph of the relationship between groove inclination angle and iron loss $W_{17/50}$.
Figure 5:
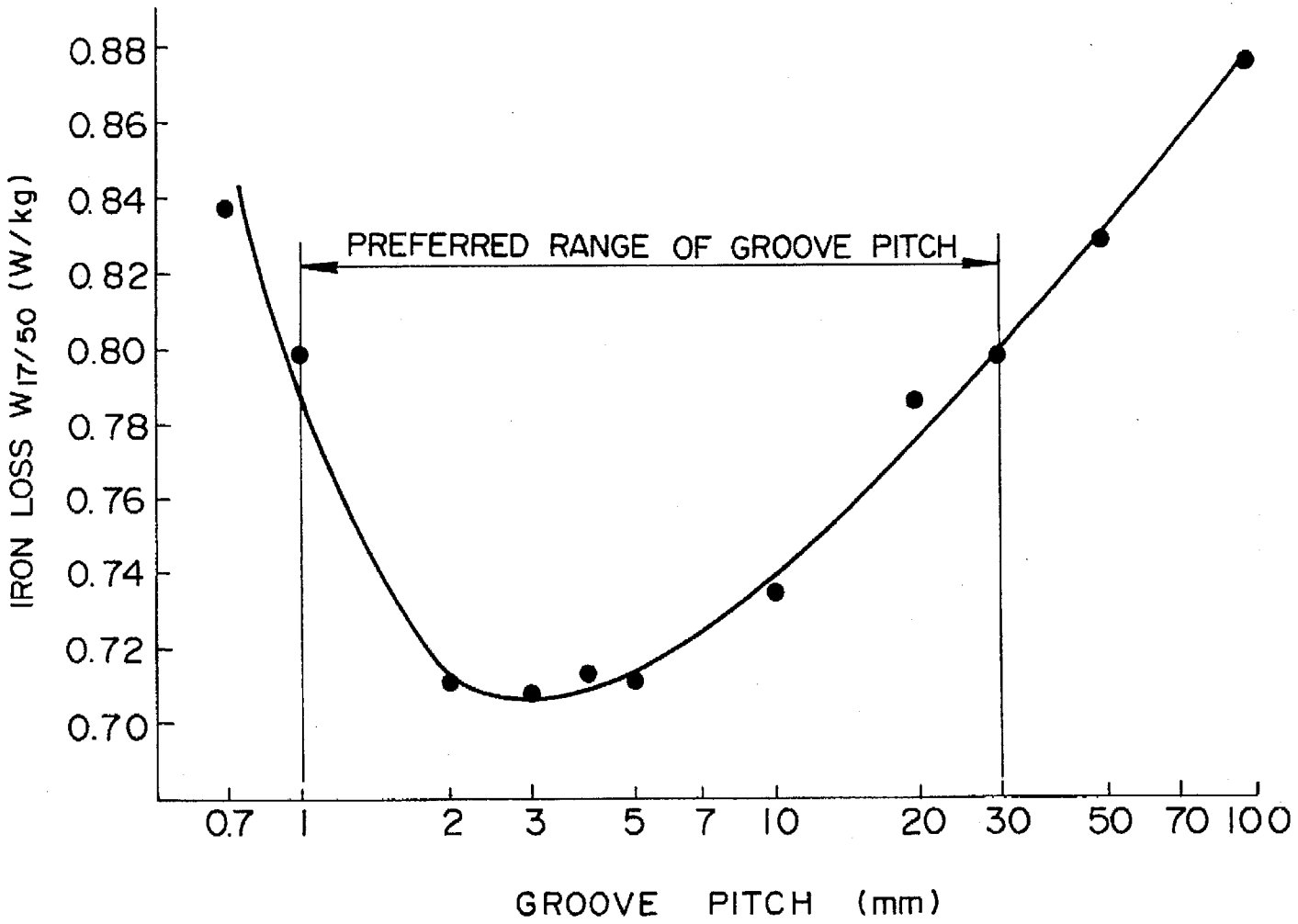
FIG. 5 is a graph of the relationship between groove pitch and iron loss $W_{17/50}$.

FIG. 4 shows the relationship between inclination angle of the linear grooves with respect to the plane perpendicular to the rolling direction and iron loss $W_{17/50}$, while FIG. 5 is a graph of the relationship between groove pitch in the rolling direction and iron loss $W_{17/50}$. These graphs reveal iron losses 0.80 W/kg or less are obtained when the groove pitch in the rolling direction ranges from about 1 to about 30 mm, and when the groove inclination angle is less than about 30°.

Figure 6:
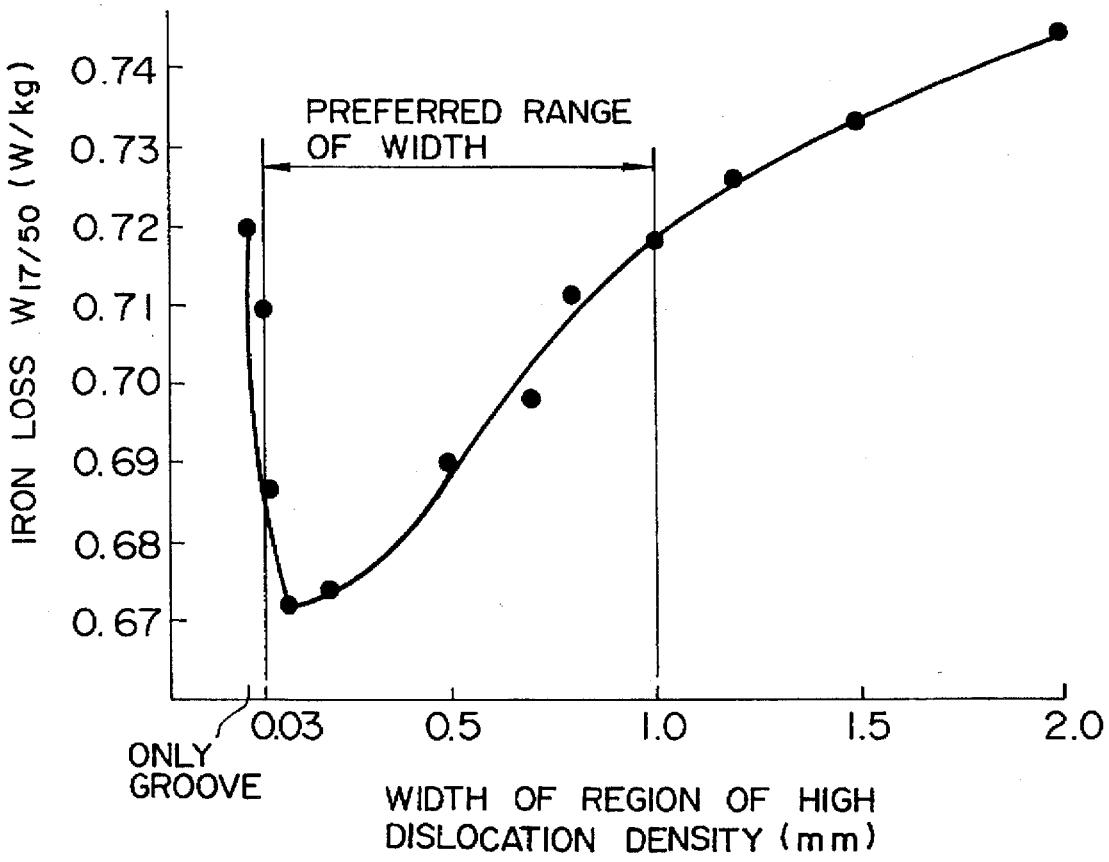
FIG. 6 is a graph of the relationship between width of the high dislocation density region and iron loss $W_{17/50}$ as observed when both grooves and high dislocation density regions simultaneously exist.

FIG. 6 shows the relationship between width of the high dislocation density region and iron loss $W_{17/50}$ as observed when both grooves and high dislocation density regions simultaneously exist. The high dislocation density regions were created by conducting a plasma flame along linear paths set between adjacent grooves about 0.150 mm wide and about 0.020 mm deep, and were formed in the direction perpendicular to the rolling direction at a pitch of about 4 mm, as described in treatment (A). The width of the high dislocation density region was varied by altering the diameter of the plasma flame nozzle and measured by observing, through a scanning electron microscope, the magnetic domain structure in the areas to which the plasma flame was applied.

FIG. 6 reveals that iron loss is reduced as compared with the case where the steel sheet has grooves alone, even when the width of the high dislocation density region exceeds about 1 mm. However, iron loss reduction becomes smaller when the width of the high dislocation density region is below about 0.030 mm. It is therefore preferred that the width of the high dislocation density region ranges from about 0.030 mm to about 1 mm.

Figure 7:
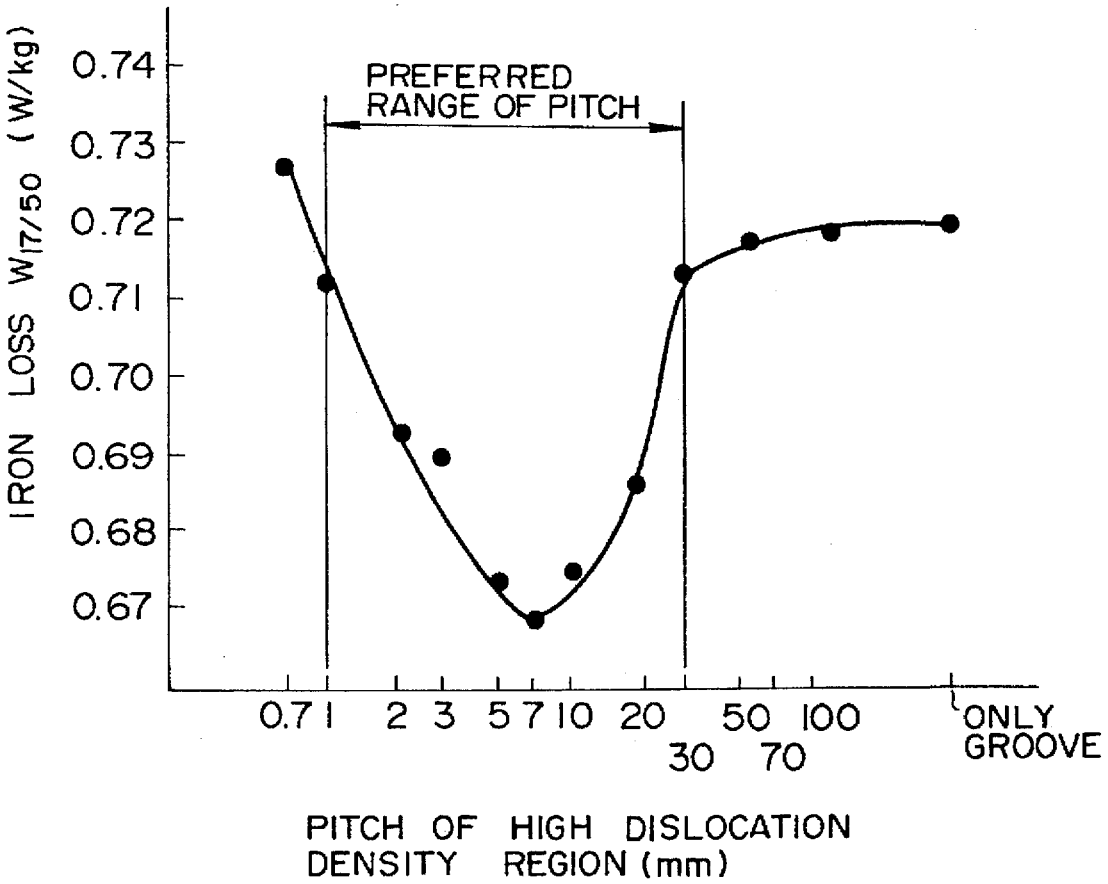
FIG. 7 is a graph of the relationship between pitch of the high dislocation density region and iron loss $W_{17/50}$ as observed when both grooves and high dislocation density regions simultaneously exist.
Figure 8:
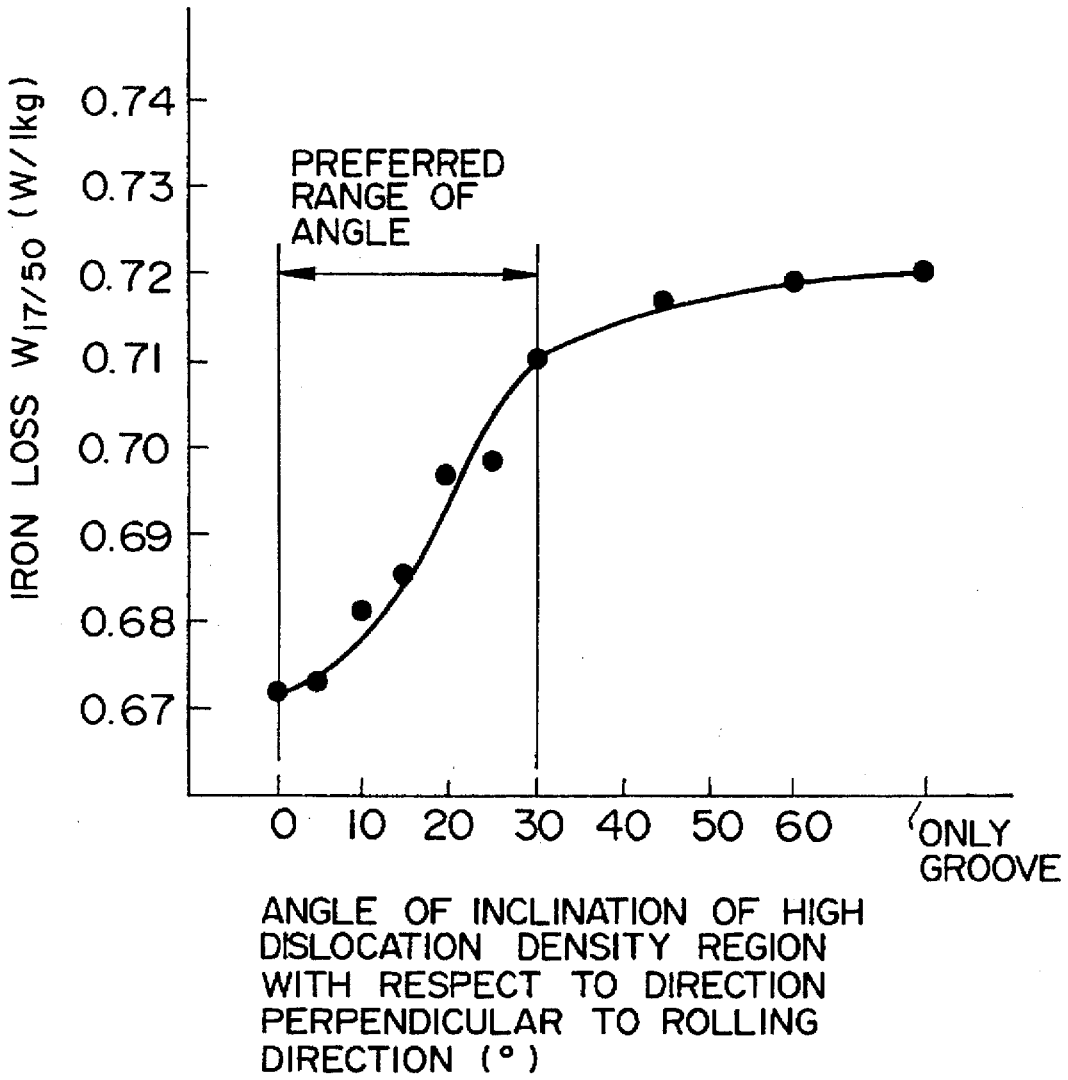
FIG. 8 is a graph of the relationship between angle of inclination of the high dislocation density region and iron loss $W_{17/50}$ as observed when both grooves and high dislocation density regions simultaneously exist.

FIG. 7 shows the relationship between pitch of the high dislocation density regions in the rolling direction and iron loss $W_{17/50}$ as observed when the width of the high dislocation density region is set to about 0.30 mm. FIG. 8 shows the relationship between angle of inclination of the high dislocation density region to a plane perpendicular to the rolling direction and iron loss $W_{17/50}$, as observed when the width of the high dislocation density region was about 0.30 mm while the pitch of the same in the rolling direction was about 4 mm.

FIGS. 7 and 8 reveal that the pitch of the high dislocation density region preferably ranges from about 1 to about 30 mm, while the inclination angle is preferably about 30° or less.

Any method of producing the grain-oriented electromagnetic steel sheet of the present invention may be employed. However, the product steel sheet must meet all the requirements described above. To this end, the following production method is preferred.

A slab of grain-oriented electromagnetic steel is hot-rolled, followed by annealing. Then, a single cold rolling stage or two or more stages of cold rolling with an intermediate annealing executed between successive cold rolling stages are effected to produce the final sheet thickness. Then, a decarburization annealing is conducted followed by a final finish annealing. Finally, a coating is applied to the finished product. Formation of the linear grooves and the high dislocation density regions is conducted either before or after the final finish annealing.

Various methods may be utilized for forming the linear grooves, such as local etching, scribing with a knife blade, rolling with a roll having linear protrusions, and the like. Most preferable among these methods which involves depositing by, for example, printing an etching resist to the steel sheet after the final finish rolling and effecting an electrolytic etching, so that linear grooves are formed in the regions devoid of the etching resist. The known method disclosed in Japanese Patent Publication No. 62-53579, which employs a toothed roll for rolling the steel sheet after finish annealing, is not recommended because this method cannot produce a width of the high dislocation density region under about 1 mm, where iron loss is minimized, although this method enables simultaneous formation of the grooves and the high dislocation density regions.

There is also no restriction in the method of forming high dislocation density regions. From the viewpoint of industrial scale production ease, methods are adoptable such as application of plasma flame as disclosed in Japanese Patent Laid-Open No. 60-236271, irradiation with a laser beam, or introduction of minute strains into the steel sheet by means of a roll having linear ridges. Among these methods, the use of roll with linear ridges is most preferred from the viewpoint of industrial production ease.

The invention can be applied to any known steel composition. A typical composition of grain-oriented electromagnetic steel will now be described.

C: about 0.01 to about 0.10 wt %

C is an element which not only uniformly refines grain structure during hot rolling and cold rolling, but also is effective in growing Goss texture. To achieve the desired effect, C content of at least about 0.01 wt % is preferred. C content exceeding about 0.10 wt %, however, causes a disorder of the Goss texture. Hence, the C content should not exceed about 0.10 wt %.

Si: about 2.0 to about 4.5 wt %

Si effectively contributes iron loss reduction by enhancing the specific resistivity of the steel sheet. Si, however, impairs cold rolling ability when its content exceeds about 4.5 wt %. On the other hand, when Si content is below about 2.0 wt %, specific resistivity is decreased such that crystal texture is rendered random due to $\alpha$–$\gamma$ transformation caused during the final high-temperature annealing conducted for the purpose of secondary recrystallization and purification. Insufficient post-annealing hardening results. For these reasons, the Si content preferably ranges from about 2.0 to about 4.5 wt %.

Mn: about 0.02 to about 0.12 wt %

Mn should constitute no less than about 0.02 wt %. Excessive Mn content, however, impairs magnetic characteristics, so that the upper limit of this element is preferably set to about 0.12 wt %.

There are generally two broad categories of inhibitors: MnS or MuSe type and AlN type.

When MnS or MuSe type inhibitor is used, the steel should contain either Se, S or both in an amount which ranges from about 0.005 wt % to about 0.06 wt % total.

Both Se and S serve as inhibitors for controlling secondary recrystallization of grain-oriented silicon steel sheet. At least about 0.005 wt % total of either or both elements are required to achieve a sufficient inhibition effect. This effect, however, is impaired when the content exceeds about 0.06 wt %. The content of Se and/or S, therefore, is preferably selected to range from about 0.01 wt % to about 0.06 wt % total.

When AlN type inhibitor is used, the steel should contain from about 0.005 to about 0.10 wt % of Al and from about 0.004 to about 0.015 wt % of N. The above-mentioned ranges of Al and N contents are used for the same reasons as those for the Fins or MuSe type inhibitor.

Both the MnS or MnSe type inhibitor and AlN type inhibitor can be used simultaneously or independently.

Inhibitor elements other than S, Se and Al, such as Cu, Sn, Cr, Ge, Sb, Mo, Te, Bi and P are also effective and one or more of them may be contained in trace amounts. More specifically, preferred content of one or more of Cu, Sn and Cr ranges from about 0.01 wt % to about 0.15 wt %, and preferred content of one or more of Ge, Sb, Mo, Te and Bi ranges from about 0.005 to about 0.1 wt %. Similarly, the preferred content of P ranges from about 0.01 wt % to about 0.2 wt %. Each inhibitor element may be used alone or in combination with others.

One advantage of the present invention is maximized when the high dislocation density regions are precisely and regularly arranged with respect to the positions of the linear grooves. It is therefore preferred that formation of the linear grooves and formation of the high dislocation density regions are conducted independently.

Such material exhibits superior performance as compared with conventional materials when used in laminated cores which do not require strain-relieving annealing, and offers performance at least equivalent to conventional materials when used in wound cores which require strain-relieving annealing.

Grain-oriented electromagnetic sheet used in studies of the second embodiment of the present invention were produced as follows: hot-rolled silicon steel sheets containing 3.2 wt % of Si and containing also MnSe and AlN as inhibitor elements were rolled down to a thickness of 0.23 mm, through a treatment including two stages of cold rolling with a single stage of intermediate annealing executed between the two cold rolling stages. Then, etching resist was applied by gravure offset printing on these steel sheets, followed by electrolytic etching, whereby linear grooves of 0.18 mm wide and 0.018 mm deep were formed to extend perpendicularly to the direction of the rolling. The pattern of the gravure roll was varied to provide different groove pitches over a range of from 0.7 mm to 100 mm for different steel sheets. The electrolytic etching was conducted by using, as an etchant, a 20% NaCl electrolytic solution bath under a current of 20 A/dm$^2$. The etching time was controlled to maintain the groove depth at 0.018 mm regardless of the variation of the width of the linear groove. The steel sheets having linear grooves formed therein were then subjected to a decarburization annealing and a subsequent final finish annealing, followed by a coating, whereby final product sheets were obtained.

Magnetic characteristics of Epstein test pieces cut out of these steel sheets were measured after a strain-relieving annealing.

The measurements confirmed that a remarkable reduction in iron loss can be attained when the pitch of the linear grooves is between about 1 mm and about 30 mm, inclusive. FIG. 5 shows the relationship.

The inventors then conducted an experiment to investigate differences in magnetic characteristics of steel sheets having the grooves formed at various pitches from 1 to 30 mm, after these steel sheets were subjected to application of a plasma flame. The plasma flame was applied using a 0.35 mm diameter nozzle, under an arc current of 7 A, and by scanning the steel sheet in the direction perpendicular to the rolling direction. The pitch of the scan paths was varied over a range between 0.7 mm and 100 mm. This process produced steel sheets containing linear regions of high dislocation density, each region having a width of 0.30 mm as measured in the direction of rolling.

Figure 9:
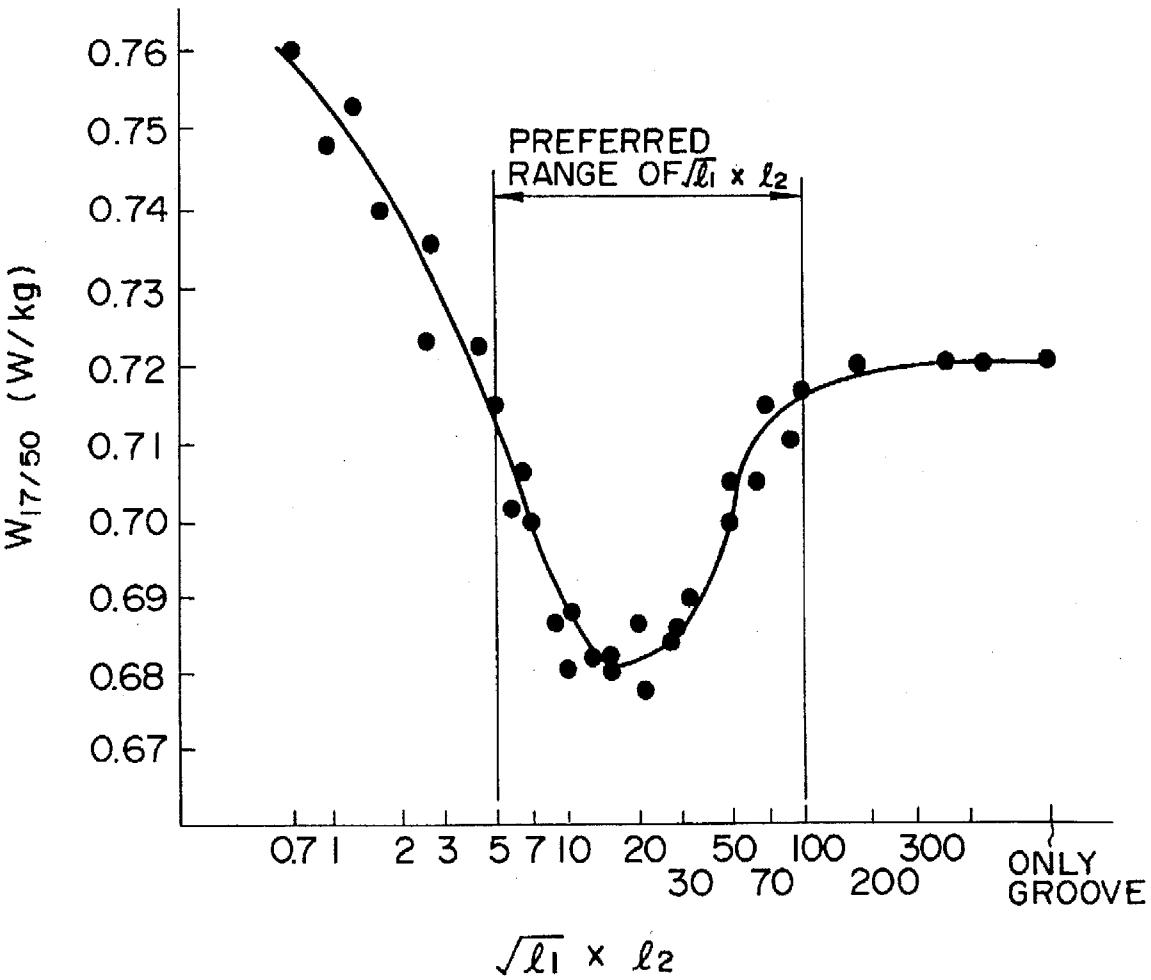
FIG. 9 is a graph of the relationship between pitch of the linear grooves and the high dislocation density regions and iron loss $W_{17/50}$.

Test pieces 150 mm wide and 280 mm long were then extracted from the steel sheets, and magnetic characteristics of the test pieces were measured by a single sheet magnetic testing device (SST). Some of the test pieces exhibited iron loss reduction while some exhibited increases in iron loss, as compared with the steel sheets untreated by a plasma flame. A detailed analysis reflected in FIG. 9 revealed that a significant iron loss reduction is obtained when the value $\sqrt{l_1 \times l_2}$ is between about 5 and about 100, inclusive, where $l_1$ represents the pitch (mm) of the linear grooves as measured in the rolling direction while $l_2$ represents the pitch (mm) of the plasma flame scan paths, respectively. When the value $\sqrt{l_1 \times l_2}$ is less than about 5, the iron loss increases as compared with the steel which has the grooves alone. This is thought to be the result of an increase in hysteresis loss due to the introduction of an excessive number of magnetic poles during formation of the high dislocation density regions. Conversely, when the value $\sqrt{l_1 \times l_2}$ is greater than about 100, iron loss reduction is impaired as compared with the steel sheets having the linear grooves alone due to the formation of too few magnetic poles.

Thus, the test results reveal remarkable iron loss reduction is achieved, as compared with steel sheets having the linear grooves alone, in steel sheet having linear grooves with a pitch $l_1$ in the rolling direction of not less than about 1 mm but not greater than about 30 mm and, at the same time, having linear regions of high dislocation density formed at pitch $l_2$ which satisfies equation (2):

$$5 \leqq \sqrt{l_1} \times l_2 \leqq 100 \quad (2)$$

Material preparation for studies of the third embodiment of the present invention was conducted as follows: hot-rolled silicon steel sheets containing 3.2 wt % of Si and both MnSe and AlN inhibitor elements were rolled down to a thickness of 0.23 mm through a treatment including two stages of cold rolling with a single stage of intermediate annealing executed between the two cold rolling stages. Then, an etching resist was applied by gravure offset printing on these steel sheets, followed by electrolytic etching, whereby linear grooves 0.18 mm wide and 0.018 mm deep were formed so as to extend perpendicularly to the direction of the rolling. The pattern of the gravure roll was varied to provide different groove pitches for different steel sheets. Specifically, the groove pitch was varied over a range of 0.7 mm to 100 mm. Electrolytic etching was conducted by using, as an etchant, a 20% NaCl electrolytic solution bath under a current of 20 A/dm$^2$. Etching time was controlled so that groove depth was maintained at 0.018 mm regardless of variations in the linear groove widths. The steel sheets having linear grooves formed therein were then subjected to a decarburization annealing and a subsequent final finish annealing, followed by a coating, whereby final product sheets were obtained.

Figure 10:
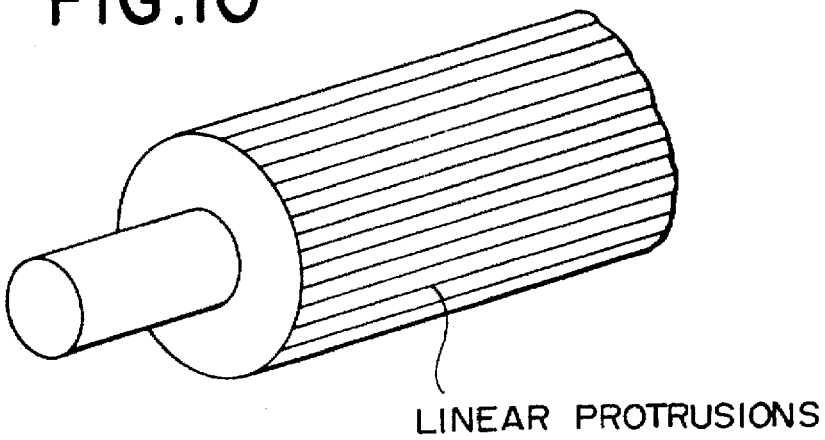
FIG. 10 is a schematic perspective view of a roll with linear protrusions.

The inventors then conducted an experiment to examine magnetic characteristic changes incurred due to introduction of minute rolling strain regions by a linearly-ridged roll in steel sheet products having linear grooves with pitches varied between 1 mm and 30 mm. The described steel sheet showed significant iron loss reduction. Introduction of minute rolling strain regions was effected by using a roll having linear axial protrusions as shown in FIG. 10. More specifically, protrusion height was 0.05 mm, while protrusion width was 0.20 mm. The introduction of minute rolling strain regions was effected by rolling the sheet with the described roll under a load of 20 kg/mm$^2$. Several types of this roll having circumferential pitches of the axial linear protrusions ranging from 1 mm to 100 mm were used to vary the pitches of the minute rolling strain regions. The process produced steel sheets containing linear regions of high dislocation density 0.30 mm wide were observed.

Test pieces 150 mm wide and 280 mm long were extracted from the product steel sheets. Magnetic characteristics of the test pieces were measured by a single-sheet magnetic testing device (SST). The results were that some of the test pieces treated by the linearly-ridged roll exhibited greater iron loss reduction than the steel sheets not treated with the roll, i.e., which have linear grooves alone, while some test pieces did not exhibit greater iron loss reduction.

Figure 11:
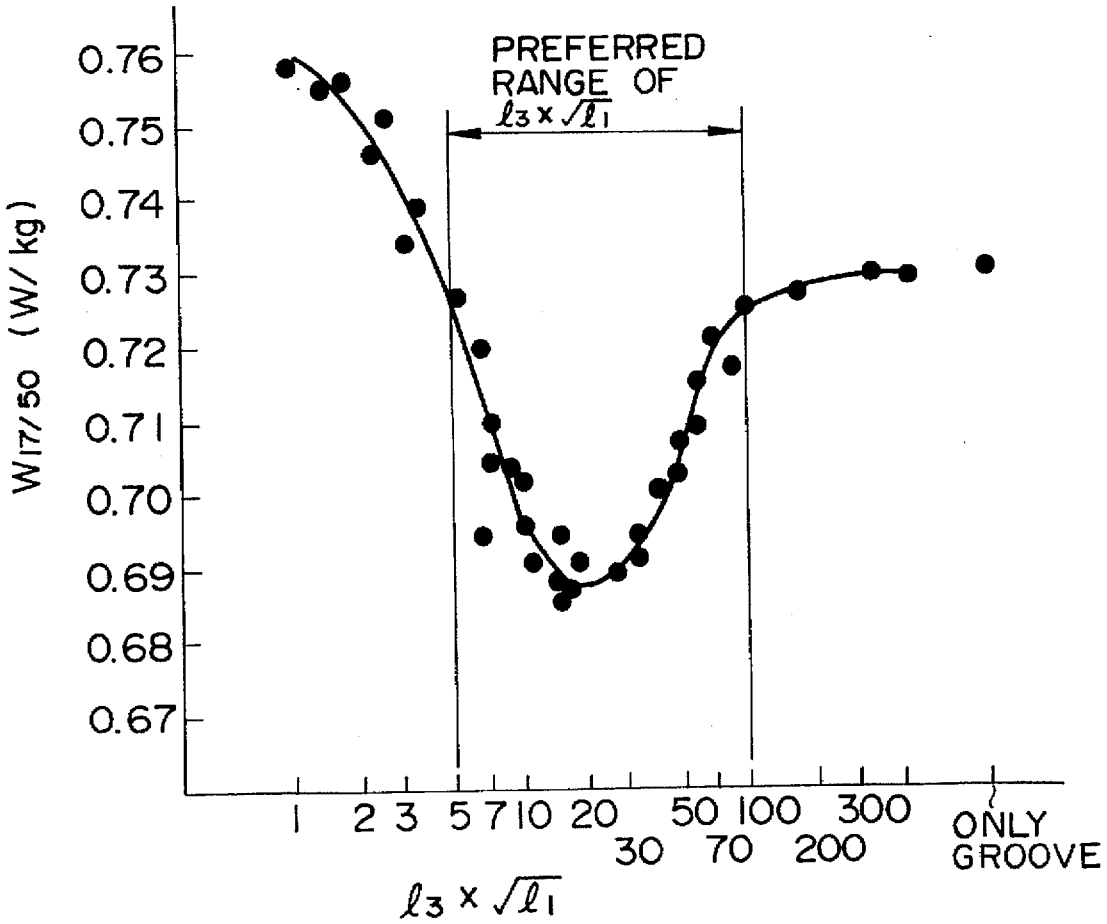
FIG. 11 is a graph showing the relationship between $\sqrt{l_1} \times l_3$ and iron loss $W_{17/50}$.

As a result of a detailed analysis of the measurements, the inventors discovered that a significant reduction in iron loss is obtained when the value of $\sqrt{l_1} \times l_3$ is between 5 and 100, inclusive, where $l_1$ represents the pitch (mm) of the linear grooves as measured in the rolling direction while $l_3$ represents the pitch (mm) of the linear protrusions of the roll, i.e., the pitch of the minute rolling strain regions, respectively. FIG. 11 shows the relationship. When the value $\sqrt{l_1} \times l_3$ is less than about 5, the iron loss increases as compared with the steel which has grooves alone. This is thought to be the result of an increase in hysteresis loss due to the introduction of an excessive number of magnetic poles during formation of the high dislocation density regions. Conversely, when the value $\sqrt{l_1} \times l_3$ is greater than about 100, iron loss reduction is not appreciable due to the formation of too few magnetic poles.

Thus, the test results reveal that remarkable iron loss reduction is achieved, as compared having the linear grooves alone, in steel sheet having minute rolling strain regions introduced at a pitch $l_3$, determined in relation to the pitch $l_1$ of the linear groves in the direction of the rolling, so as to satisfy the following equation (3):

$$5 \leqq \sqrt{l_1} \times l_3 \leqq 100 \quad (3)$$

To maximize iron loss reduction, it is preferred that the width and the depth of the linear grooves range between about 0.03 mm and about 0.30 mm and between about 0.01 mm and about 0.07 mm, respectively. This is because groove widths and depths smaller than the lower range limits do not provide sufficient minute magnetic domain formation, whereas groove widths and depths larger than the upper range limits cause a drastic magnetic flux density reduction.

Preferably, the direction of the grooves is within about 30° of the direction perpendicular to the rolling direction, because minute magnetic domain generation is seriously impaired when the described angle exceeds about 30°.

The above-mentioned linearly-ridged roll is preferably but not exclusively used as the means for imparting the minute rolling strain regions. The linear protrusions formed on the roll may have rounded or flattened ends, although rounded ends are generally more durable. Linear protrusion width preferably ranges from about 0.05 mm to about 0.50 mm, because a width under about 0.05 mm cannot provide an appreciable effect because the minute strain regions become too small, while a width exceeding about 0.50 mm causes too much strain so as to incur increased hysteresis losses. The height of the linear protrusions, although not restrictive, preferably ranges from about 0.01 mm to about 0.10 mm from the viewpoint of practical use. As stated before, the pitch $l_3$ (mm) of the linear protrusions should satisfy equation (3). The directions of the linear protrusions on the roll may form an angle to the axis of the roll, provided that the angle is not greater than about 30°, although it is preferred that the linear protrusions extend in parallel with the roll axis. The surface pressure applied during the rolling with this roll preferably ranges from about 10 kg/cm$^2$ to about 70 kg/cm$^2$. This is because a surface pressure less than about 10 kg/cm$^2$ is not effective in introducing the minute rolling strain regions, while a surface pressure exceeding about 70 kg/cm$^2$ creates strain enough to increase hysteresis loss.

No restrictions concerning the positional relationship between the linear grooves and the minute rolling strain regions are necessary. The minute rolling strain regions may completely overlap the linear grooves, or may be formed between adjacent linear grooves such that the linear grooves and the minute rolling strain regions appear alternately, or may intersect the linear grooves. Furthermore, the linear grooves and the minute rolling strain regions may be formed on the same surface of the steel sheet or in the opposite surfaces of the steel sheet.

The rolls with linear protrusions as described above provide a particularly effective means for introducing the minute rolling strain regions, although other means may be used such as a plurality of spaced steel wires which are applied against the steel sheets so as to introduce mechanically strained regions.

In accordance with the present invention, a grain-oriented electromagnetic steel sheet may be produced by hot-rolling a grain-oriented electromagnetic steel sheet followed by an annealing as required. The steel sheet is then rolled down to the final thickness through at least two stages of cold rolling conducted with an intermediate annealing executed between each adjacent stage of cold rolling. Then, decarburization annealing and a subsequent final finish annealing are conducted followed by a coating, whereby a coated steel sheet as the final product is obtained.

Linear grooves may be formed either before or after the final finish rolling. The linear grooves may be formed by, for example, a local etching, scribing with a cutting blade or edge, rolling with a roll having linear protrusion, or other means. Among these methods, the most preferred is depositing of an etching resist to the cold-rolled steel sheet by, for example, a printing, and a subsequent treatment such as electrolytic etching.

Then, minute rolling strain regions are introduced. The steel sheet thus produced exhibits superior performance when used as the material of a laminated core, which does not require strain-relieving annealing. Even when used as a material of a wound core which requires strain-relieving annealing, the described steel sheet exhibits performance equivalent to those of known materials.

The following Examples are merely illustrative and are not intended to define or limit the scope of the invention, which is defined in the appended claims.

EXAMPLE 1

A hot-rolled 3.3 wt % silicon steel sheet was prepared to have a composition containing C: 0.070 wt %, Si: 3.3 wt %, Mo: 0.069 wt %, Se: 0.018 wt %, Sb: 0.024 wt %, Al: 0.021 wt % and N: 0.008 wt %. The steel sheet was rolled down to the thickness of 0.23 mm through two stages of cold rolling which were conducted with an intermediate annealing executed therebetween. Then, an etching resist was applied by a gravure printing, and an electrolytic etching was conducted followed by removal of the etching resist in an alkali solution, whereby linear grooves of 0.16 mm wide and 0.019 mm deep were formed at a pitch of 3 mm in the direction of rolling, such that the grooves extend in a direction which is inclined at 10° to the direction perpendicular to the rolling direction. The steel sheet was then subjected to a decarburization annealing, final finish annealing and finish coating. A plurality of steel sheets thus obtained were subjected to plasma flame treatments conducted under varying conditions (F) to (H), described hereinafter, so as to introduce local high dislocation density regions. In all treatments, the plasma flame was applied by using a nozzle having a 0.35 mm diameter nozzle bore, and under an arc current of 7.5 A.

Plasma flame treatments (F) to (H) are defined as follows:

(F) Plasma flame applied along paths which were determined at a pitch of 6 mm and inclined at 10° to the direction perpendicular to the rolling direction, such that the paths were parallel to the linear grooves and positioned between adjacent linear grooves.

(G) Plasma flame was applied in a direction crossing the linear grooves. The angle and pitch of the plasma flame paths were the same as those in (F).

(H) Plasma flame was applied at a pitch of 6 mm, so as to overlap the linear grooves.

For comparison purposes, treatments were conducted under one of the following conditions:

(I) Plasma flame was not applied; only the groove forming treatment was conducted.

(J) Plasma flame was applied under the same conditions as (F), without formation of linear grooves.

Six test pieces 150 mm wide and 280 mm long were cut out of each of the product coils thus obtained, along the width of each coiled sheet. Magnetic characteristics of these test pieces were measured by a single sheet magnetic testing device, without being subjected to strain-relieving annealing. The results are shown in Table 2.

TABLE 2

| Symbols | Treatment | $W_{17/50}$ (W/kg) | $B_8$ (T) | Remarks |
|---|---|---|---|---|
| F | High dislocation density regions formed in parallel with grooves and set between adjacent grooves | 0.66 | 1.91 | Invention |
| G | High dislocation density regions formed to intersect grooves | 0.67 | 1.91 | Invention |
| H | High dislocation density regions formed to overlap linear grooves | 0.70 | 1.91 | Comparison |
| I | Only linear grooves are formed | 0.71 | 1.91 | Comparison |
| J | Only high dislocation density regions formed | 0.70 | 1.93 | Comparison |

Table 2 reveals that the materials to which high dislocation density regions were introduced so as not to overlap the grooves exhibit remarkable reductions in iron loss as compared with the comparison materials.

EXAMPLE 2

A steel sheet 0.18 mm thick was obtained by treating, by an ordinary method, a hot-rolled silicon steel sheet having a composition containing C: 0.071 wt %, Si: 3.4 wt %, Mn: 0.069 wt %, Se: 0.020 wt %, Al: 0.023 wt % and N: 0.008 wt %. Using a supersonic oscillator, minute linear grooves of insulating film were removed from the steel sheet, followed by a pickling in a 30% $HNO_3$ solution, whereby linear grooves 0.18 mm wide and 0.015 mm deep were formed so as to extend in the direction perpendicular to the rolling direction at a pitch of 4 mm in the direction of rolling. Then, a coating was applied again. Plasma flame was then applied in accordance with one of the following conditions (K) to (M), so as to locally introduce high dislocation density regions. The plasma flame was applied by using a nozzle having a nozzle bore diameter of 0.35 mm, and under an arc current of 7 A.

Plasma flame treatments (K) to (M) are defined as follows:

(K) Plasma flame was applied at a 4 mm pitch parallel to the linear grooves at positions between adjacent linear grooves.

(L) Plasma flame was applied at a 4 mm pitch so as to be inclined at 15° to the direction perpendicular to the rolling direction.

(M) Plasma flame applied at a 4 mm pitch so as to overlap the linear grooves.

For comparison purposes, treatments were conducted under one of the following conditions.

(N) Plasma flame was not applied; steel sheet has undergone only the groove forming treatment.

(O) Plasma flame was applied along paths perpendicular to the rolling direction, at a 4 mm pitch, without conducting the groove forming treatment.

Test pieces were obtained from the thus-obtained product coils and were subjected to magnetic characteristic measurements to obtain the results shown in Table 3.

TABLE 3

| Symbols | Treatment | $W_{17/50}$ (W/kg) | $B_8$ (T) | Remarks |
|---|---|---|---|---|
| K | High dislocation density regions formed in parallel with grooves and set between adjacent grooves | 0.65 | 1.90 | Invention |
| L | High discoloration density regions formed to intersect grooves at 15° | 0.64 | 1.90 | Invention |
| M | High dislocation density regions formed to overlap linear grooves | 0.68 | 1.90 | Comparison |
| N | Only linear grooves are formed | 0.70 | 1.90 | Comparison |
| O | Only high dislocation density regions formed | 0.68 | 1.92 | Comparison |

Table 3 reveals that the materials having high dislocation density regions which do not overlap the grooves exhibit remarkable reductions in iron loss as compared with comparison materials.

EXAMPLE 3

A hot-rolled 3.3% silicon steel sheet containing, as inhibitor elements, MnSe, Sb and AlN, was rolled down to 0.23 mm thick through two stages of cold rolling with a single stage of intermediate annealing executed therebetween. Then, an etching resist was applied by gravure offset printing, followed by electrolytic etching and removal of the resist in an alkali solution, whereby linear grooves 0.16 mm wide and 0.018 mm deep were formed to extend at an inclination angle of 10° with respect to a direction perpendicular to the rolling direction and at a pitch of 3 mm in the direction of the rolling ($l_1$=3 mm). Then, the steel sheet was subjected to decarburization annealing and a subsequent final finish annealing, followed by a finish coating. A plurality of thus-obtained sheets were subjected to plasma flame treatments to introduce local high dislocation density regions. The plasma flame was applied using a nozzle having a nozzle bore diameter of 0.35 mm, and under an arc current of 7.5 A. A pitch ($l_2$) of the plasma flame path ranging from 1 mm to 100 mm was applied to test pieces 150 mm wide and 280 mm long extracted from the steel sheet products. The test pieces were then subjected to measurement by a single sheet magnetic testing device (SST) to obtain the results as shown in Table 4. For comparison purposes, magnetic characteristics of steel sheets devoid of the high dislocation density regions are also shown in Table 4.

TABLE 4

| No. | Pitch of high dislocation density regions $l_2$ (mm) | $\sqrt{l_1 \times l_2}$ | $W_{17/50}$ (W/kg) | $B_8$ (T) | Remarks |
|---|---|---|---|---|---|
| 1 | 1 | 1.7 | 0.74 | 1.90 | Comparison |
| 2 | 3 | 5.1 | 0.71 | 1.91 | Invention |
| 3 | 10 | 17.3 | 0.68 | 1.91 | Invention |
| 4 | 20 | 34.6 | 0.69 | 1.91 | Invention |
| 5 | 50 | 86.0 | 0.70 | 1.91 | Invention |
| 6 | 100 | 173.2 | 0.72 | 1.91 | Comparison |
| 7 | None (grooves alone) | — | 0.72 | 1.91 | Comparison |

Table 4 reveals that the steel sheets having the high dislocation density regions formed at a pitch of $l_2$ (mm) determined in relation to $l_1$ (mm) so as to satisfy equation (2), $5 \leqq \sqrt{l_1 \times l_2} \leqq 100$, provide remarkable reductions in iron loss as compared with the comparison materials.

EXAMPLE 4

A hot-rolled 3.2% silicon steel sheet containing MnSe and AlN inhibitor elements was treated in accordance with a known process to produce a steel sheet 0.18 mm thick. Then, using a supersonic oscillator, insulating film was removed from the steel sheet in the form of fine linear strips, followed by pickling in a 30% $HNO_3$ solution, whereby linear grooves of 0.18 mm wide and 0.015 mm deep, extending at an inclination, were formed at a pitch of 3 mm ($l_1$=3 mm). Then, a finish coating was conducted. A plasma flame was applied to the thus-obtained steel sheet so as to locally introduce high dislocation density regions, using a plasma nozzle having a nozzle bore diameter of 0.35 mm, and under supply of an arc current of 7 A, while varying pitch $l_2$ of the plasma flame path between 1 mm and 80 mm. Test pieces of 150 mm wide and 280 mm long were extracted from the thus-obtained product steel sheets and were subjected to measurement of magnetic characteristics conducted by using an SST to obtain the results as shown in Table 5. For comparison purposes, magnetic characteristics as measured on steel sheets devoid of high dislocation density regions, i.e., having the linear grooves alone, are also shown in Table 5.

TABLE 5

| No. | Pitch of high dislocation density regions $l_2$ (mm) | $\sqrt{l_1 \times l_2}$ | $W_{17/50}$ (W/kg) | $B_8$ (T) | Remarks |
|---|---|---|---|---|---|
| 8 | 1 | 1.7 | 0.71 | 1.89 | Comparison |
| 9 | 3 | 5.1 | 0.70 | 1.89 | Invention |
| 10 | 10 | 17.3 | 0.67 | 1.90 | Invention |
| 11 | 20 | 34.6 | 0.68 | 1.91 | Invention |
| 12 | 50 | 86.6 | 0.70 | 1.90 | Invention |
| 13 | 80 | 138.6 | 0.71 | 1.90 | Comparison |
| 14 | None (grooves alone) | — | 0.71 | 1.90 | Comparison |

From Table 5, it will be seen that the steel sheets having the high dislocation density regions formed at a pitch of $l_2$ (mm) determined in relation to $l_1$ (mm) so as to satisfy equation (2), $5 \leqq \sqrt{l_1 \times l_2} \leqq 100$, provide a remarkable reduction in iron loss as compared with the comparison materials.

EXAMPLE 5

A hot-rolled 3.3% silicon steel containing, as inhibitor elements, MnSe, Sb and AlN, was rolled down to 0.23 mm thick through two stages of cold rolling executed with a single stage of intermediate annealing executed therebetween. Then, an etching resist was applied by gravure offset printing, followed by electrolytic etching and removal of the resist in an alkali solution, whereby linear grooves 0.16 mm wide and 0.018 mm deep were formed to extend at an inclination angle of 10° with respect to a direction perpendicular to the rolling direction and at a pitch of 3 mm in the direction of the rolling ($l_1$=3 mm). Then, the steel sheet was subjected to decarburization annealing and a subsequent final finish annealing, followed by a finish coating. A plurality of thus-obtained sheets were subjected to a rolling treatment conducted with a roll having linear protrusions, for the purpose of introduction of local high dislocation density regions. The roll used in this treatment had linear protrusions 0.02 mm high, extending in parallel to the roll axis, under a rolling load of 30 kg/mm$^2$. The pitch of the linear protrusions was varied over a range of 1 mm to 100 mm. Test pieces 150 mm wide and 280 mm long were extracted from the thus-obtained steel sheet products and were subjected to measurement of a single sheet magnetic testing device (SST) to obtain the results as shown in Table 6. For comparison purposes, magnetic characteristics of steel sheets having the linear grooves alone, i.e., steel sheets which had not undergone the rolling treatment, and characteristics of steel sheets which are devoid of the linear grooves, i.e., the steel sheets which had undergone only the rolling treatment, are also shown in Table 6.

TABLE 6

| No. | Pitch of the linear protrusions of the roll $l_3$ (mm) | $\sqrt{l_1} \times l_2$ | $W_{17/50}$ (W/kg) | $B_8$ (T) | Remarks |
|---|---|---|---|---|---|
| 15 | 1 | 1.7 | 0.73 | 1.89 | Comparison |
| 16 | 3 | 5.1 | 0.70 | 1.90 | Invention |
| 17 | 10 | 17.3 | 0.69 | 1.91 | Invention |
| 18 | 20 | 34.6 | 0.68 | 1.91 | Invention |
| 19 | 50 | 86.6 | 0.71 | 1.91 | Invention |
| 20 | 100 | 173.2 | 0.72 | 1.91 | Comparison |
| 21 | None (grooves alone) | — | 0.72 | 1.91 | Comparison |
| 22 | Only rolling treatment | — | 0.74 | 1.92 | Comparison |

Table 6 reveals that the steel sheets having minute rolling strain regions introduced by the rolling treatment at a pitch $l_3$ (mm) determined in relation to the groove pitch $l_1$ (mm) so as to satisfy equation (3), $5 \leqq \sqrt{l_1} \times l_3 \leqq 100$, provide a remarkable reduction in iron loss over the comparison steel sheets which have the linear grooves alone, and over the steel sheets which have undergone only the rolling treatment without experiencing the groove forming treatment.

Selected of the steel sheets shown in Table 6 were subjected to a 3-hour strain-relieving annealing conducted at 800° C. in an $N_2$ atmosphere. The steel sheet No. 22 which received only the rolling treatment with the roll having linear protrusions exhibited an increase in iron loss from the 0.74 W/kg shown in Table 6 to 0.87 W/kg, while among the steel sheets of the invention (Nos. 16 to 19), the greatest iron loss value measured only reached 0.72 W/kg.

EXAMPLE 6

Hot-rolled 3.2% silicon steel, containing MuSe, Sb and AlN as inhibitor elements, was treated by a known process so as to produce a steel sheet 0.18 mm thick. Using a supersonic oscillator, insulating coating film on the steel sheet was locally removed in the form of fine linear strips, followed by a pickling in a 30% $HNO_3$ solution, whereby linear grooves 0.18 mm wide and 0.015 mm deep, extending in a direction perpendicular to the rolling direction, were formed at a pitch $l_3$ of 3 mm. Then, a finish coating was conducted. Then, high dislocation density regions were introduced by a rolling treatment conducted by using a roll which had linear protrusions of 0.02 mm high, extending parallel to the roll axis, under a rolling load of 25 kg/mm$^2$. The pitch of the linear protrusions was varied over a range of from 1 mm to 80 mm. Test pieces of 150 mm wide and 280 mm long were extracted from the thus-obtained steel sheet products and subjected to measurement of a single sheet magnetic testing device (SST) to obtain the results as shown in Table 7. For comparison purposes, magnetic characteristics of steel sheets having the linear grooves alone, i.e., steel sheets which had not undergone the rolling treatment, and characteristics of steel sheets which are devoid of the linear grooves, i.e., the steel sheets which had undergone only the rolling treatment, are also shown in Table 7.

TABLE 7

| No. | Pitch of the linear protrusions of the roll $l_3$ (mm) | $\sqrt{l_1} \times l_2$ | $W_{17/50}$ (W/kg) | $B_8$ (T) | Remarks |
|---|---|---|---|---|---|
| 23 | 1 | 1.7 | 0.73 | 1.89 | Comparison |
| 24 | 3 | 5.1 | 0.70 | 1.89 | Invention |
| 25 | 10 | 17.3 | 0.68 | 1.90 | Invention |
| 26 | 20 | 34.6 | 0.69 | 1.90 | Invention |
| 27 | 50 | 86.8 | 0.69 | 1.90 | Invention |
| 28 | 100 | 138.6 | 0.71 | 1.90 | Comparison |
| 29 | None (grooves alone) | — | 0.71 | 1.90 | Comparison |
| 30 | Only rolling treatment | — | 0.72 | 1.91 | Comparison |

Table 7 reveals that the steel sheets having minute rolling strain regions introduced by the rolling treatment at a pitch $l_3$ (mm) determined in relation to the groove pitch $l_1$ (mm) so as to satisfy equation (3), $5 \leqq \sqrt{l_1} \times l_3 \leqq 100$, provide a remarkable reduction in iron loss over the comparison steel sheets which have the linear grooves alone, and over the steel sheets which have undergone only the rolling treatment without experiencing the groove forming treatment.

These steel sheets were subjected to a 3-hour strain-relieving annealing conducted at 800° C. in an $N_2$ atmosphere. The steel sheet No. 30 which received only the rolling treatment with the roll having linear protrusions exhibited an increase the iron loss from the 0.72 W/kg shown in Table 7 to 0.82 W/kg, while among the steel sheets of the invention (Nos. 24 to 27) the greatest iron loss value measured only reached 0.71 W/kg.

The present invention exhibits remarkably reduced iron loss as compared with conventional materials. Thus, the invention greatly improves the efficiency of transformers, particularly transformers having laminate iron cores.

Particularly, the present invention enables production of grain-oriented electromagnetic steel sheet which provides a remarkable reduction in iron loss through introduction of linear regions of high dislocation density under specific conditions into a finish-annealed grain-oriented electromagnetic steel sheet which has been provided with linear grooves extending in a direction substantially perpendicular to the direction of rolling, thus making a great contribution to the improvement in efficiency of transformers.

What is claimed is:

1. A grain-oriented electromagnetic steel sheet comprising a finish-annealed grain-oriented steel sheet, said steel sheet having a multiplicity of linear grooves formed in a surface thereof, said linear grooves extending in a direction crossing the direction of rolling of said steel sheet at a predetermined pitch in the direction of rolling, and a multiplicity of linear high dislocation density regions extending in a direction crossing the direction of rolling of said steel sheet at a predetermined pitch in the direction of rolling at positions substantially different from positions where said linear grooves are formed.

2. A grain-oriented electromagnetic steel sheet according to claim 1, wherein the directions in which said linear grooves and said high dislocation density regions form an angle or angles which are not greater than about 30° with respect to the direction perpendicular to the direction of rolling.

3. A grain-oriented electromagnetic steel sheet according to claim 1, wherein each of said linear grooves has a width of from about 0.03 mm to about 0.30 mm and a depth of from about 0.01 mm to about 0.07 mm, while each of said high dislocation density regions has a width of from about 0.03 mm to about 1 mm.

4. A grain-oriented electromagnetic steel sheet according to claim 1, wherein the pitch of said linear grooves ranges from about 1 mm to about 30 mm.

5. A grain-oriented electromagnetic steel sheet according to claim 1, wherein the pitch of said high dislocation density regions ranges from about 1 mm to about 30 mm.

6. A low-iron-loss grain-oriented electromagnetic steel sheet comprising a finish-annealed grain-oriented steel sheet, said steel sheet having a multiplicity of linear grooves formed in a surface thereof, said linear grooves extending in a direction substantially perpendicular to the direction of rolling of said steel sheet at a predetermined pitch in the direction of rolling, and a multiplicity of linear high dislocation density regions extending in a direction substantially perpendicular to the direction of rolling of said steel sheet at a predetermined pitch in the direction of rolling, wherein pitch $l_1$ (mm) of said linear grooves and pitch $l_2$ (mm) of said high dislocation density regions satisfy equations (1) and (2):

$$1 \leqq l_1 \leqq 30 \text{ (mm)} \quad (1)$$

$$5 \leqq \sqrt{l_1} \times l_2 \leqq 100. \quad (2)$$

7. A method of producing a low-iron-loss grain-oriented electromagnetic steel sheet comprising:

forming linear grooves in a surface of a finish-annealed grain-oriented electromagnetic steel sheet, said linear grooves extending in a direction crossing the direction of rolling of said steel sheet at a pitch $l_1$ (mm) in the direction of rolling; and introducing linear minute regions of rolling strain extending in a direction crossing the direction of rolling at a pitch $l_3$ (mm), said pitch $l_3$ determined from equations (1) and (3):

$$1 \leqq l_1 \leqq 30 \text{ (mm)} \quad (1)$$

$$5 \leqq \sqrt{l_1} \times l_3 \leqq 100. \quad (3)$$

8. A method according to claim 7, wherein each of said linear grooves has a width of from about 0.03 mm to about 0.30 mm and a depth of from about 0.01 mm to about 0.07 mm and extend in a direction which forms an angle not greater than about 30° to a direction which is perpendicular to the direction of rolling.

9. A method according to claim 7 wherein the introduction of said minute linear regions of rolling strain is conducted by applying force against said steel sheet with a roll having linear axial protrusions at a surface pressure of about 10 to about 70 kg/mm$^2$, said linear axial protrusions of said roll having a width of from about 0.05 mm to about 0.50 mm and a height of from about 0.01 mm to about 0.10 mm and extending in a direction which forms an angle of not greater than about 30° to the roll axis.

10. A method according to claim 8 wherein the introduction of said minute linear regions of rolling strain is conducted by applying force against said steel sheet with a roll having linear axial protrusions at a surface pressure of about 10 to about 70 kg/mm$^2$, said linear axial protrusions of said roll having a width of from about 0.05 mm to about 0.50 mm and a height of from about 0.01 mm to about 0.10 mm and extending in a direction which forms an angle of not greater than about 30° to the roll axis.

* * * * *

UNITED STATES PATENT AND TRADEMARK OFFICE

CERTIFICATE OF CORRECTION

PATENT NO. : 5,665,455

DATED : September 9, 1997

INVENTOR(S) : Keiji Sato, Masayoshi Ishida, Kunihiro Senda, Kazuhiro Suzuki and Michiro Komatubara It is certified that error appears in the above-indentified patent and that said Letters Patent is hereby corrected as shown below:

On the Cover page, item [75] Inventors:, please change "Seiji" to --Keiji--.

In Column 7, line 30, please change "MuSe" to --MnSe--; line 31, please change "MuSe" to --MnSe--; and line 46, please change "Fins" to --MnS-- and change "MuSe" to --MnSe--.

In Column 15, line 46, please change "MuSe" to --MnSe--.

Signed and Sealed this

Eighteenth Day of November 1997

*Attest:*

Bruce Lehman

BRUCE LEHMAN

*Attesting Officer*

*Commissioner of Patents and Trademarks*